US007066450B2

(12) United States Patent
Lundrigan

(10) Patent No.: US 7,066,450 B2
(45) Date of Patent: Jun. 27, 2006

(54) WYSE MID-SPAN WINCH KIT

(76) Inventor: Brian E. Lundrigan, 1460 Conception, Bay South, NL (CA) A1X 6M9

( * ) Notice: Subject to any disclaimer, the term of this patent is extended or adjusted under 35 U.S.C. 154(b) by 139 days.

(21) Appl. No.: 10/820,007

(22) Filed: Apr. 8, 2004

(65) Prior Publication Data

US 2005/0224774 A1 Oct. 13, 2005

(51) Int. Cl.
*B25B 25/00* (2006.01)

(52) U.S. Cl. ..... 254/225; 248/371; 248/205.1

(58) Field of Classification Search ..... 254/224, 254/225, 227; 248/371, 174, 205.1
See application file for complete search history.

(56) References Cited

U.S. PATENT DOCUMENTS

| | | | | |
|---|---|---|---|---|
| 1,177,767 A | | 4/1916 | Eggleston | |
| 1,806,606 A | | 5/1931 | Booth | |
| 3,861,126 A | * | 1/1975 | Morrison | 54/23 |
| 4,552,167 A | | 11/1985 | Bräkelmann | |
| 4,588,167 A | | 5/1986 | Finzel | |
| 4,776,553 A | * | 10/1988 | Kobayashi | 248/558 |
| 5,738,340 A | * | 4/1998 | Brantner | 254/337 |
| 5,915,658 A | * | 6/1999 | Sheng | 248/346.06 |
| 5,947,450 A | * | 9/1999 | Grapes | 254/329 |
| 5,971,363 A | * | 10/1999 | Good | 254/323 |
| 6,019,330 A | * | 2/2000 | Affrunti | 248/237 |
| 6,511,089 B1 | * | 1/2003 | Kores, Sr. | 280/478.1 |
| 6,631,885 B1 | * | 10/2003 | Halas | 254/225 |
| 6,726,182 B1 | * | 4/2004 | Topping et al. | 254/376 |
| 2005/0079037 A1 | * | 4/2005 | Boyd | 414/462 |

* cited by examiner

*Primary Examiner*—Emmanuel M Marcelo
(74) *Attorney, Agent, or Firm*—Patent & Trademark Services Inc.; Joseph H. McGlynn

(57) ABSTRACT

A portable mounting system for a winch, which enables a standard winch to function to pull two objects closer together, without requiring the winch to be mounted to a vehicle.

7 Claims, 2 Drawing Sheets

WYSE MID-SPAN WINCH KIT

BACKGROUND OF THE INVENTION

The present invention relates to a portable mounting system for a winch. More specifically, it relates to a portable mounting system for a winch, which improves the utility of the winch by enabling it to function in a wider variety of situations.

DESCRIPTION OF THE PRIOR ART

In the prior art, various types of winches have been proposed. For example U.S. Pat. No. 1,177,767 to Eggleston discloses a winch mounted to a cable attached to a vehicle.

U.S. Pat. No. 1,806,606 to Booth discloses a winch mounted to a cable which is in turn secured to a vehicle.

U.S. Pat. No. 4,588,167 to Finzel discloses a frame for mounting a winch to a vehicle.

U.S. Pat. No. 4,552,340 to Sheppard discloses a winch mounted to a cable attached to a vehicle.

While these winches accomplish their intended purpose in many situations, they suffer from a number of drawbacks. For example, an important factor in the utility of these winches is the need to mount them to a vehicle. Mounting a winch to a vehicle limits the winch's direction of pull. For this reason, in some situations involving all-terrain vehicles (ATVs), the mounted winch is of little or no use. Also, the winch's ability to tow the vehicle to which it is mounted is often severely, if not prohibitively, limited.

Furthermore, since winches must be mounted in some fashion, they are currently not available for use on many vehicles (e.g. Skidoos, cars, etc.).

This situation can be problematic for the user, as it limits the utility of a device which, by design, is intended to be used in unanticipated and/or emergency situations.

In order to overcome these problems, what is needed is a mounting system for a winch, which expands the directionality of pull and the range of situations in which the winch may be used, thus addressing and solving problems associated with conventional devices.

SUMMARY OF THE INVENTION

This invention relates to a portable mounting system for a winch, which enables a standard winch to function as an independent unit to pull two objects closer together, thus improving the utility of the winch by enabling it to function in a wider variety of situations.

It is an object of the invention disclosed herein to provide a new and improved system for mounting and employing a winch, which enables a standard winch to be utilized without requiring it to be mounted to a vehicle.

It is another object of the invention disclosed herein to provide a new and improved system for mounting and employing a winch, which expands the directionality of pull of the winch.

It is yet another object of the invention disclosed herein to provide a new and improved system for mounting and employing a winch, which provides novel utility and flexibility in wider range of towing situations.

It is a further object of the present invention to provide a technique for increasing the spooling efficiency and obtaining maximum transfer of power from the winch to the object being moved.

It is an advantage of the invention disclosed herein to enable a standard winch to be utilized in a greater range of towing applications, without being mounted to a vehicle.

It is another advantage of the invention disclosed herein to increase the spooling efficiency and obtain maximum transfer of power from the winch to the object being moved.

These and other objects and advantages of the present invention will be fully apparent from the following description, when taken in connection with the annexed drawings.

BRIEF DESCRIPTION OF THE DRAWINGS

The teachings of the present invention can be readily understood by considering the following detailed description in conjunction with the accompanying drawings, in which.

DETAILED DESCRIPTION OF EXEMPLARY EMBODIMENTS

The WYSE winch kit, being a Mid-span system, has two attachment points. These are the shackle, and the winch cable. Via these two points the system pulls two objects together. When the WYSE Mid-span winch system is in operation, the object attached to the shackle will remain at the same distance to the winch. The object to which the winch cable is attached will move closer to the winch, or the object attached to the shackle will move with the WYSE mid-span winch system closer to the object which the winch cable is attached to, depending on the use of the system.

Figure 1:
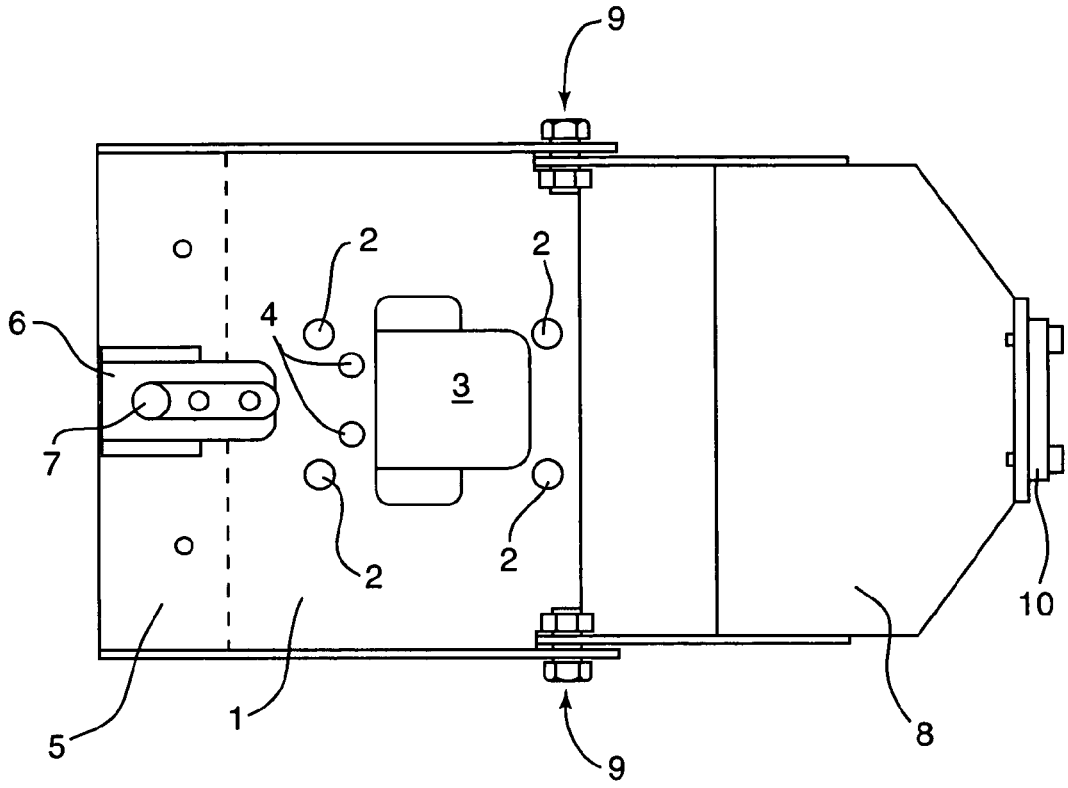
FIG. 1 depicts a top view of an example of a mounting system for a winch according to the principles of the present invention.

Referring now to the drawings in greater detail, FIG. 1 shows a top view of the WYSE Mid-Span winch kit, according to one example of the present invention. A mounting plate 1 includes a means for a winch to be securely attached to it. The example of FIG. 1 shows four possible holes 2 in mounting plate 1 which may receive bolts used to attach the winch to mounting plate 1, or attached to the winch itself depending on the type of winch used on the system. The rear end of a flex plate 3 may also be attached to mounting plate 1. The support plate 3 is made from a high tension flexible material, for example steel. The example of FIG. 1 shows two holes 4 in flex plate 3 which receive bolts used to securely attach flex plate 3 to mounting plate 1. When a winch is mounted, it is attached to mounting plate 1, with the cable drum resting on flex plate 3. The high tension flexible nature of flex plate 3 allows the cable drum to move in response to movements of the cable drum, thus applying constant pressure against the cable drum and ensuring a consistent spooling pattern even during times of slack cable operation. While FIG. 1 indicates bolts used to attach both the winch and flex plate 3 to mounting plate 1, other means of making these secure attachments may be used as well. Also, cut-outs may be employed to reduce the weight of mounting plate 1.

Toward the rear of mounting plate 1 is a rectangular area 5, which includes a smaller area 6 of extra thickness. The interior of area 6 contains a hole 7, which is used to receive a shackle 14 (illustrated in FIG. 2).

A guide plate 8 is attached via hinge points 9 to mounting plate 1. Guide plate 8 is capable of rotating about hinge points 9 from approximately 90 degrees for storage purposes and out to such an angle as to achieved the desired orientation during operation. Guide plate 8 includes a cable guide 10 which loosely holds and guides the cable. As in the case of mounting plate 1, cut-outs may be used to reduce the weight of guide plate 8. Together, cable guide 10 and guide plate 8 enable the WYSE mid-span winch kit to stabilize and guide the cable in response to erratic movements of the cable, thus providing superior spooling capability compared to a stand-alone winch. Guide plate 8 with cable guide 10 prevents the WYSE mid-span kit from twisting left or right in a horizontal plane during operation, thus preventing the winch cable 12 from stacking on either end of the winch drum 13.

Figure 2:
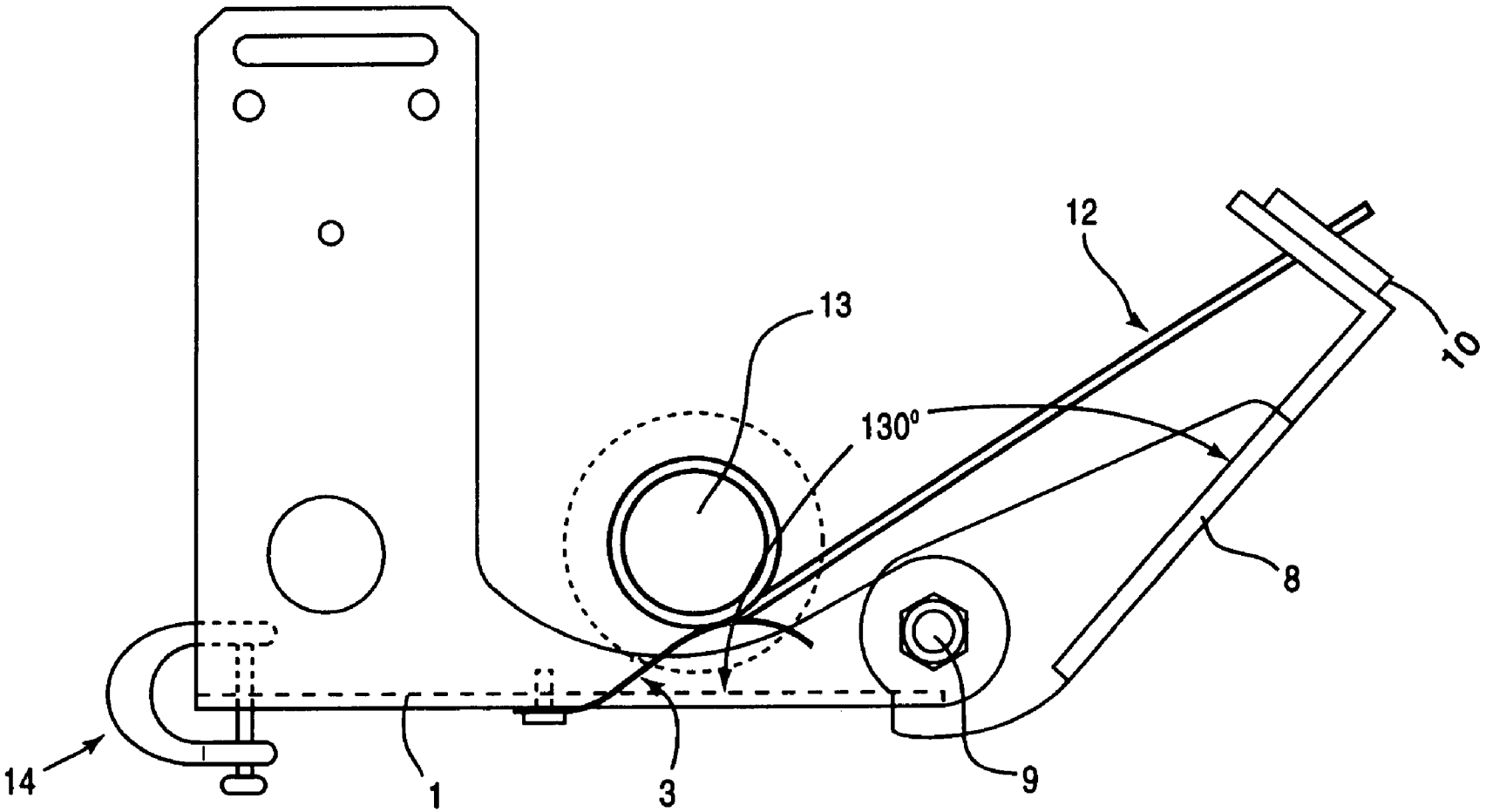
FIG. 2 depicts a cross-sectional view of an example of a mounting system for a winch according to the principles of the present invention.

FIG. 2 shows a cross-sectional view of an example of the present invention. FIG. 2 illustrates flex plate 3 attached to mounting plate 1, with flex plate 3 applying pressure to winch drum 13. Guide plate 8 rotates about hinge points 9 as necessary to stabilize the movement of cable 12. Cable guide 10 is shown guiding cable 12. FIG. 2 also illustrates a shackle 14, which passes through hole 7 and is used to attach the WYSE mid-span winch kit to a fixed object such as a vehicle bumper.

FIG. 1 illustrates a view of the WYSE mid-span winch kit. Conventional winches which mount to the WYSE system may be electrically powered, and may therefore require a suitable power source for operation. Accordingly, an electrical control box may be attached to the mounting plate 1 in area of 5. The electrical control box may be equipped with a conventional power cord of a fixed length, and a standard connector (not shown), which will plug into another connector on the end of a pigtail. The control box may also have a conventional terminal, (not shown) which accepts a convenient low current wired hand control unit of fixed length. As well, the unit may be equipped to accept an available module for wireless operation.

In order to use the WYSE mid-span mounting kit, the user mounts a winch to mounting plate 1. If the winch is electrically operated, the user locates and connects a source of electrical power to the winch, via electrical control box. The user attaches the WYSE mid-span mounting kit to an object via shackle 14. After locating a structurally sound point the user extends the winch cable 12. The winch passes through cable guide 10 and attaches to a separate sound. After checking that all connections are secure, the user engages the power, causing the winch to retract cable 12 onto the winch drum, thereby drawing the objects closer together. Flex plate 3 maintains constant pressure against the cable. Guide plate 8 also maintains the unit in a position of desired orientation during operation, in which case hinged section 8 may be in an extended position. When the user no longer requires the use of the winch, the user retracts cable 12, and folds guide plate 2 to a 90 degree (vertical) position to assume a more compact shape for storage.

Although the WYSE Mid-Span Winch Kit has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A mounting system for a winch, said mounting system comprising:

a mounting plate having a first end and a second end, a flex plate made from a flexible material, said flex plate having a first end and a second end, said second end of said flex plate is attached to said mounting plate, and said first end of said flex plate is free of said mounting plate, whereby said flex plate can flex with respect to said mounting plate, a guide plate having a first end and a second end, said second end of said guide plate being mounted to said first end of said mounting plate by a hinged connection, whereby said guide plate can pivot with respect to said mounting plate, a cable guide securely attached to said fast end of said guide plate, means for securely attaching said second end of said mounting plate to a fixed object, and a cable drum mounted adjacent said support plate and said flex plate, said cable drum resting on said first end of said flex plate.

2. The mounting system of claim 1, wherein said winch is electrically powered.

3. The mounting system of claim 1, wherein said means for attaching said second end of said mounting plate to said fixed object is a shackle.

4. The mounting system of claim 1, wherein said guide plate can pivot with respect to said mounting plate from an angle of approximately 90 degrees to an angle such that the desired orientation is achieved during operation, and said angles being measured from a plane of said mounting plate relative to a plane of said guide plate.

5. The mounting system of claim 1, wherein said flex plate is made from high tension flexible steel.

6. The mounting system of claim 1, wherein said winch is attached to said mounting plate by means of a plurality of bolts.

7. The mounting system of claim 1, wherein said means for attaching said second end of said mounting plate to said mounting plate is a plurality of bolts.

* * * * *